US006655427B1

(12) United States Patent
Chiang

(10) Patent No.: US 6,655,427 B1
(45) Date of Patent: Dec. 2, 2003

(54) WOOD PLANING MACHINE WITH AN ERROR REDUCING UNIT FOR A WORKPIECE THICKNESS TO BE REMOVED

(76) Inventor: Pei-Lieh Chiang, 12, Nan-Ping Rd., Nan Dist., Taichung City (TW)

( * ) Notice: Subject to any disclaimer, the term of this patent is extended or adjusted under 35 U.S.C. 154(b) by 0 days.

(21) Appl. No.: 10/259,074

(22) Filed: Sep. 27, 2002

(30) Foreign Application Priority Data

Jul. 24, 2002 (TW) ..... 91211330 U

(51) Int. Cl.[7] ..... B27C 1/00

(52) U.S. Cl. ..... 144/130; 74/22 A; 74/27; 144/117.1

(58) Field of Search ..... 74/22 A, 27, 144, 74/441; 403/343, 345, 347; 409/156, 210, 218; 144/114.1, 117.1, 129, 130

(56) References Cited

U.S. PATENT DOCUMENTS 5,967,205 A * 10/1999 Welsh et al. ..... 144/117.1
6,089,286 A * 7/2000 Liao ..... 144/117.1
6,315,015 B1 * 11/2001 Chang ..... 144/117.1
6,415,829 B1 * 7/2002 Chiang ..... 144/130
6,427,734 B1 * 8/2002 Chiang ..... 144/130
6,546,975 B1 * 4/2003 Liao et al. ..... 144/130

* cited by examiner

*Primary Examiner*—W. Donald Bray
(74) *Attorney, Agent, or Firm*—Atkin, Gump, Strauss, Hauer & Feld, L.L.P.

(57) ABSTRACT

A wood planing machine includes a carriage having four corners mounted on a base via four hollow posts. Four screw rods are disposed rotatably in the posts. Four tubular threaded members are secured to the corners of the carriage, and are disposed within the posts, respectively. Each of the threaded members defines a threaded bore for engaging the respective screw rod, and has an internally threaded portion, and a circumferential slot formed through the internally threaded portion to divide the same into upper and lower parts. The upper part has a bottom surface confining a top end of the slot. The lower part is formed with a threaded bore therethrough. A locking bolt engages the threaded bore in the lower part, and presses against the bottom surface of the upper part such that threads on the upper parts press upwardly against the screw rods and that threads on the lower parts press downwardly against the screw rods.

3 Claims, 10 Drawing Sheets

WOOD PLANING MACHINE WITH AN ERROR REDUCING UNIT FOR A WORKPIECE THICKNESS TO BE REMOVED

CROSS REFERENCE TO RELATED APPLICATION

This application claims priority of Taiwanese Application No. 091211330, filed on Jul. 24, 2002.

BACKGROUND OF THE INVENTION

1. Field of the Invention

The present invention relates to a wood planing machine, more particularly to a wood planing machine with an error reducing unit for a workpiece thickness to be removed.

2. Description of the Related Art

Referring to FIGS. 1 to 3, a conventional wood planing machine 10 is shown to include a base 11 having left and right sides, left and right pairs of posts 12 extending uprightly from the left and right sides of the base 11, a cutter carriage 13 having left and right carriage ends 131 mounted slidably and respectively on the left and right pairs of posts 12, and left and right screw rods 16 mounted rotatably on the left and right sides of the base 11. Tubular left and right threaded members 15 extend through two through holes in the left and right carriage ends 131. The left and right screw rods 16 extend through and threadedly engage the threaded members 15, respectively. Left and right fastening nuts 19 threadedly and respectively engage the threaded members 15 so as to secure the threaded members 15 on the cutter carriage 13. A transmission unit 18 includes two sprockets 181 fixed to lower ends of the left and right screw rods 16, and a transmission chain 182 trained on the sprockets 181 so as to permit synchronous rotation of the left and right screw rods 16, which, in turn, results in vertical movement of the cutter carriage 13 relative to the base 11. A handle 17 is mounted on a top end of the right screw rod 16 to facilitate turning of the left and right screw rods 16.

Referring to FIG. 4, the cutter carriage 13 is parallel to the base 20, and the threads 150 of the threaded members 15 rest on the threads 160 of the screw rods 16 due to the weight of the cutter carriage 13. Thus, clearances 161 are formed between the threads 150 of the threaded member 15 and the threads 160 of the screw rods 16. As such, the threaded members 15 and the carriage 13 can move relative to the screw rods 16, thereby resulting in an increase in error for workpiece thickness that is to be removed.

SUMMARY OF THE INVENTION

Therefore, the object of this invention is to provide a wood planing machine with an error reducing unit that can prevent movement of a cutter carriage relative to a set of upright screw rods.

Accordingly, a wood planing machine of the present invention includes: a base having four corners; four hollow posts extending uprightly from the corners of the base, respectively, each of the posts being formed with an axial slot for access to an interior thereof; four screw rods extending rotatably and uprightly from the corners of the base through the posts, respectively, each of the screw rods having an externally threaded portion that is formed with an external thread; a cutter carriage having four corners mounted respectively, vertically and slidably on the posts, and a horizontal bottom surface; a transmission unit connected to the screw rods to permit synchronous rotation of the screw rods; and an error reducing unit including four tubular threaded members that are secured respectively to the four corners of the carriage, that are disposed respectively within the posts in such a manner that the threaded members are exposed from the axial slots in the posts, and that define axially extending threaded bores respectively engaging the screw rods such that rotation of the screw rods results in movement of the carriage along the posts. Each of the threaded members has an internally threaded portion defining a respective one of the axially extending threaded bores and engaging the externally threaded portion of the respective one of the screw rods 50, and a circumferential slot formed through a wall of the internally threaded portion so as to divide the internally threaded portion into an upper part and a lower part. The upper part is disposed above the circumferential slot, and has a bottom surface that defines a top end of the circumferential slot. The lower part is disposed below the circumferential slot, and is formed with a vertically extending threaded bore therethrough. Each of the upper and lower parts is formed with an internal thread that engages the external thread of the respective one of the screw rods. The error reducing unit further includes four locking bolts that engage respectively the vertically extending threaded bores in the threaded members and that press against the bottom surfaces of the upper parts of the internally threaded portions of the threaded members such that the internal threads of the upper parts of the threaded members press upwardly against the external threads of the screw rods and such that the internal threads of the lower parts of the threaded members press downwardly against the external threads of the screw rods so as to lock the internally threaded portions of the threaded members on the externally threaded portions of the screw rods.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
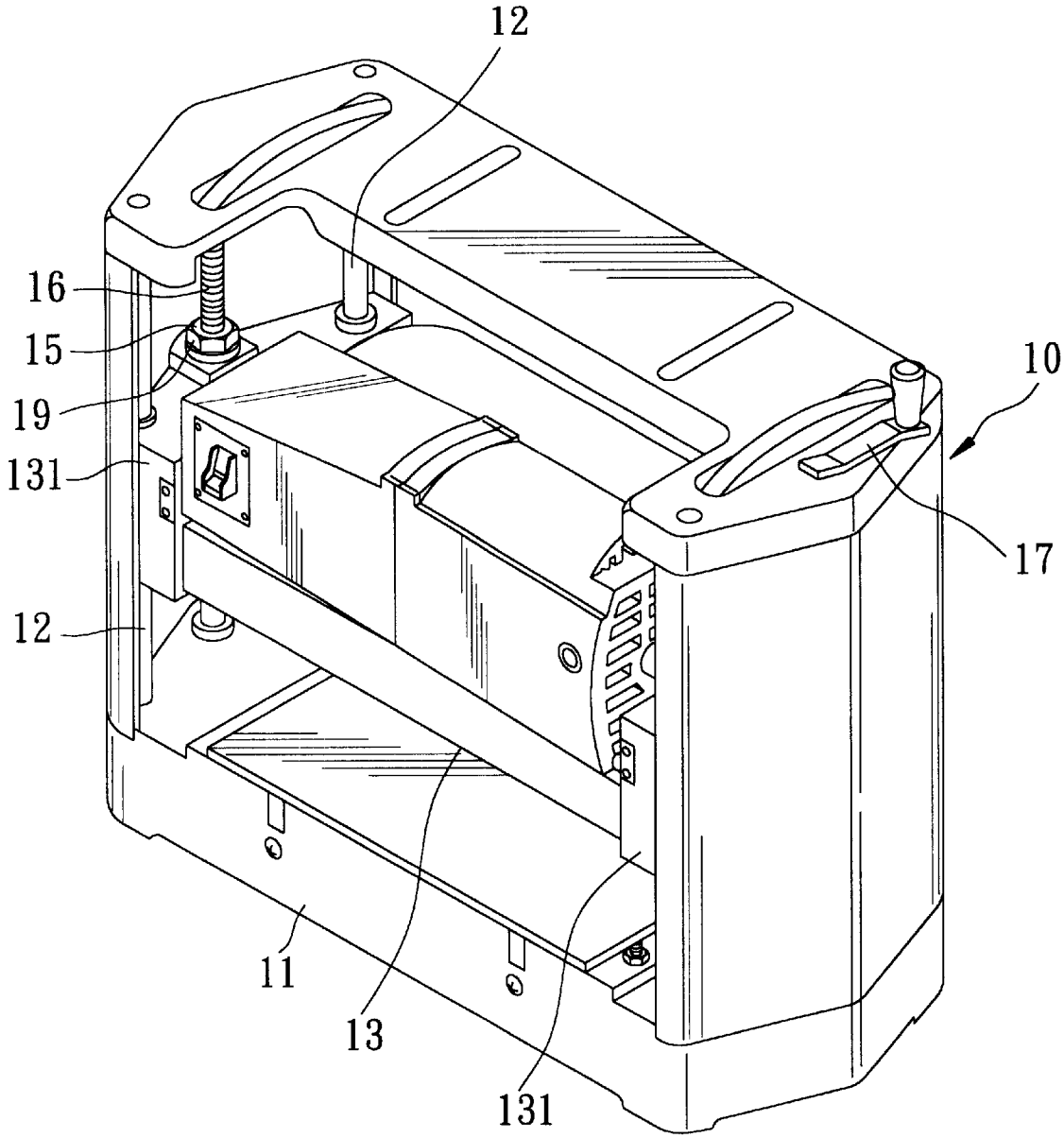
FIG. 1 PRIOR ART
FIG. 1 is a perspective view of a conventional wood planing machine.
Figure 2:
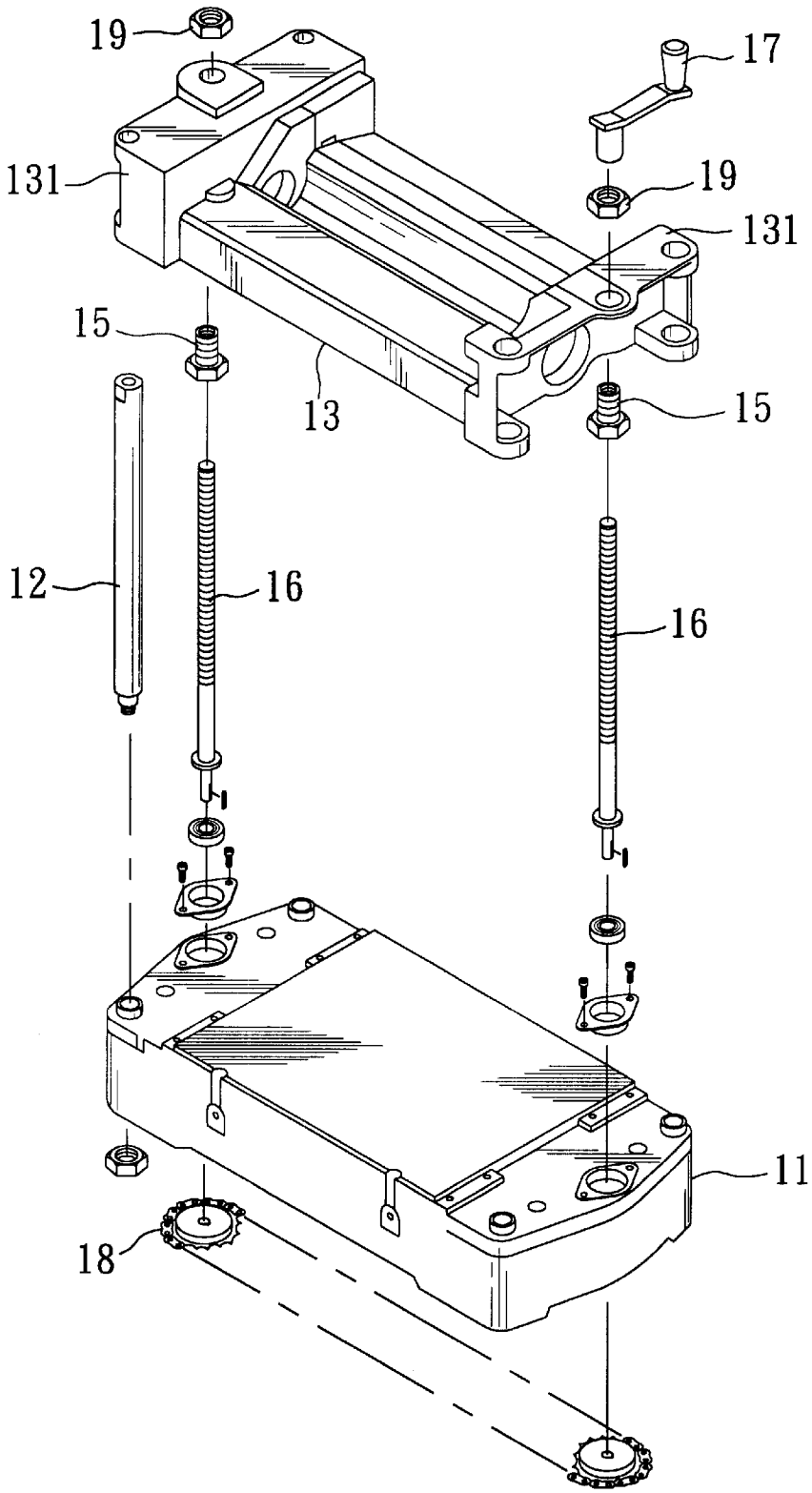
FIG. 2 PRIOR ART
FIG. 2 is a fragmentary exploded perspective view of the conventional wood planing machine.
Figure 3:
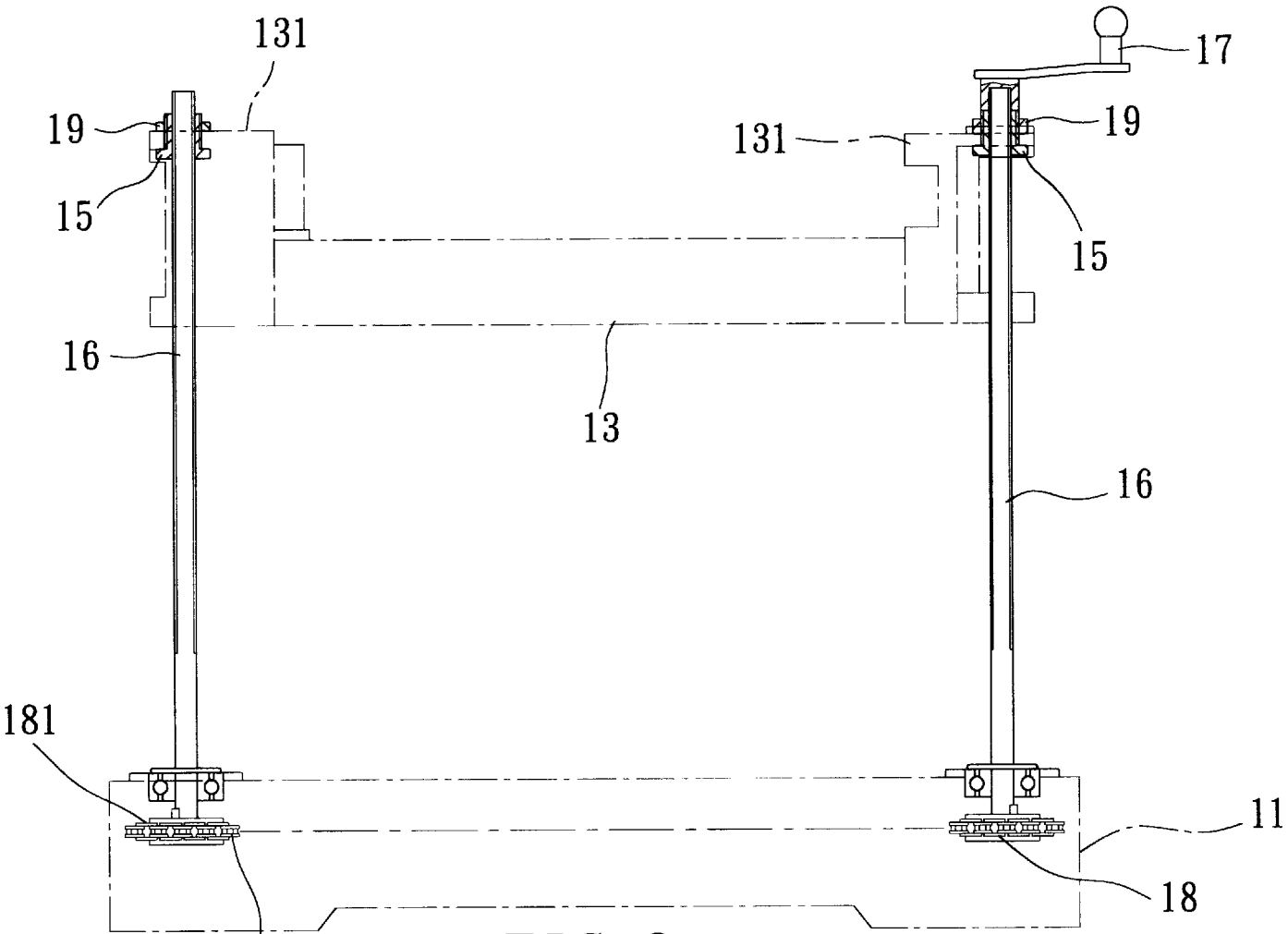
FIG. 3 PRIOR ART
FIG. 3 is a partly sectional fragmentary schematic view of the conventional wood planing machine, in which a cutter carriage and a base are shown in phantom lines.
Figure 4:
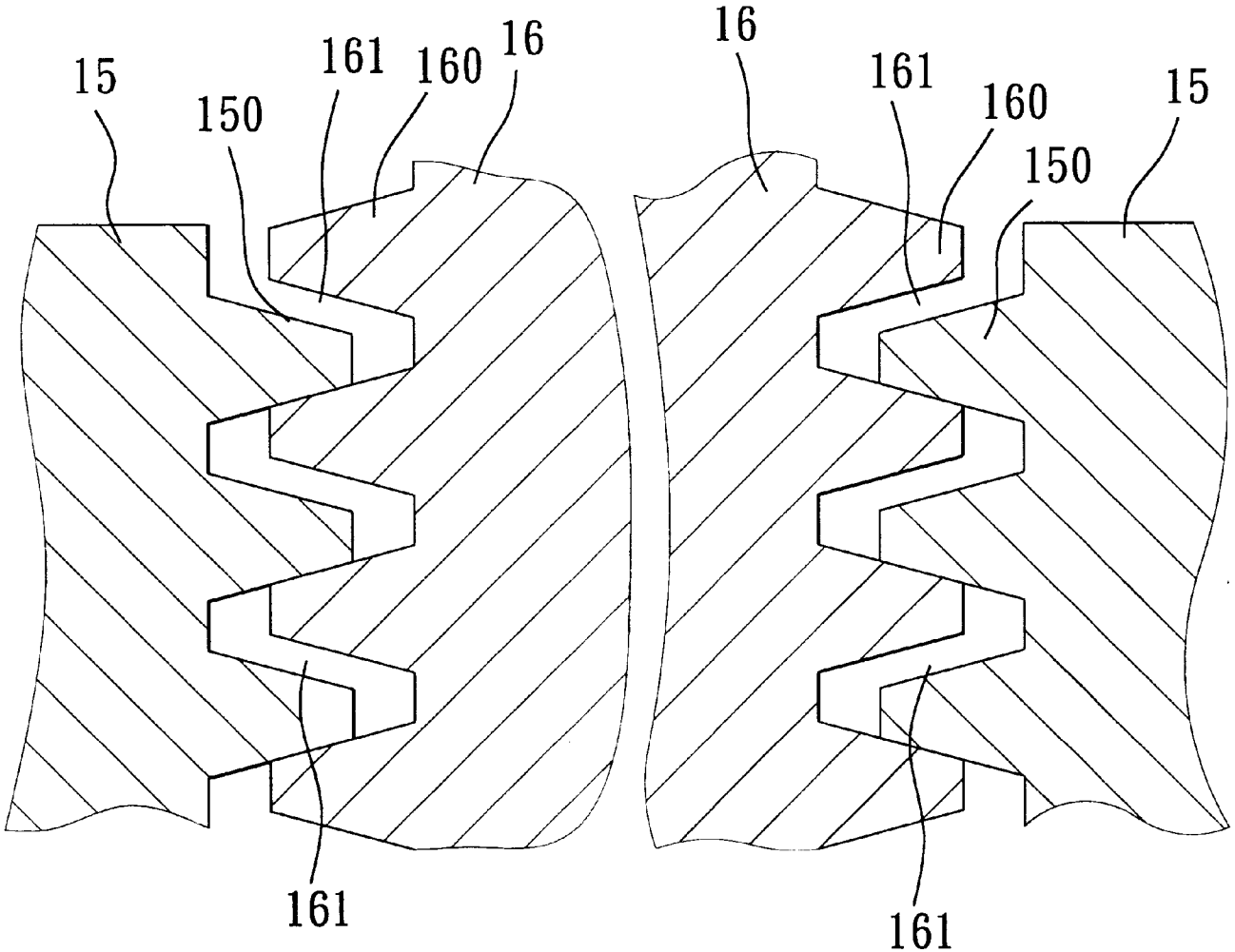
FIG. 4 illustrates how a thread of a threaded member rests on a thread of a screw rod in the conventional wood planing machine.
Figure 5:
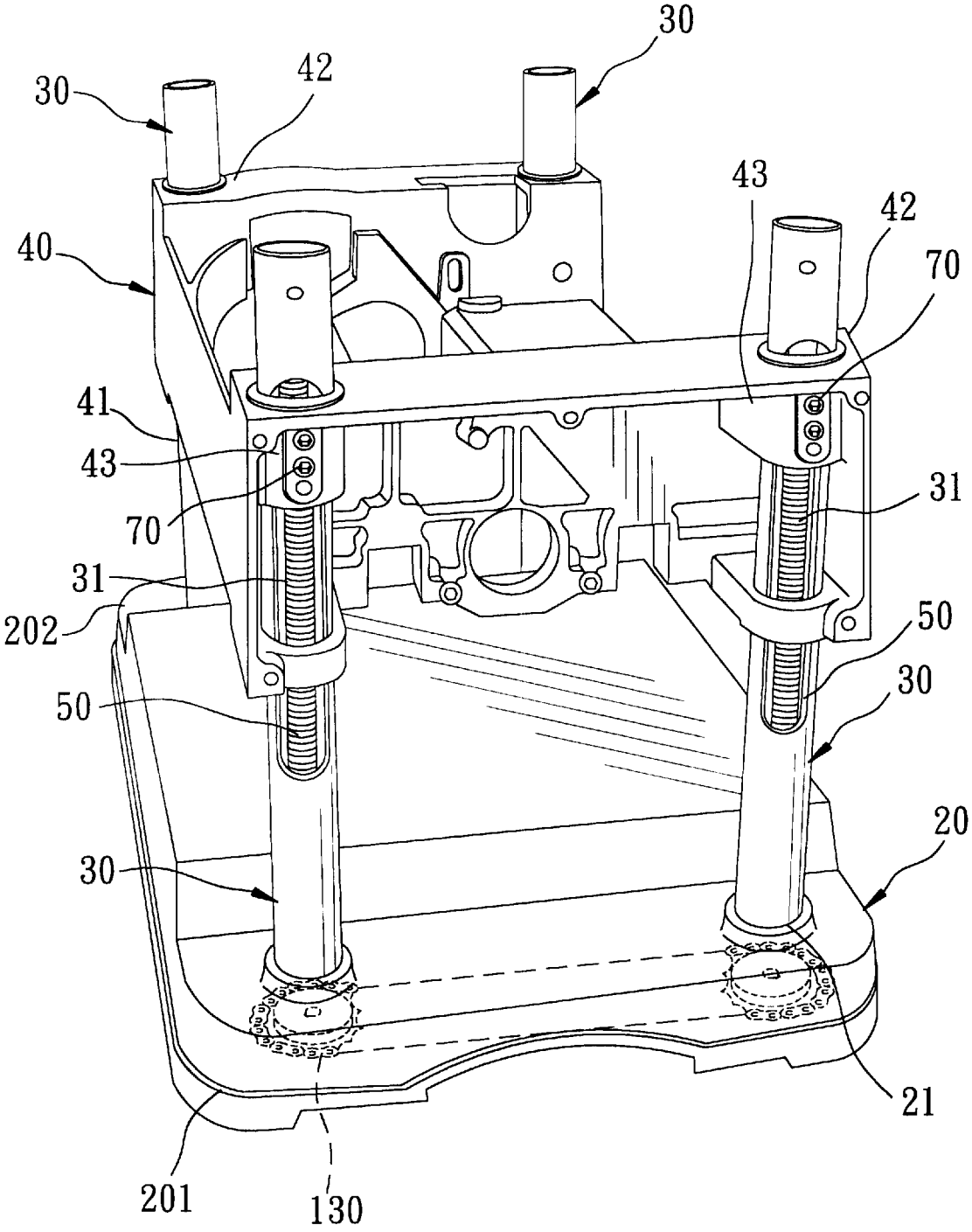
FIG. 5 is a perspective view of a preferred embodiment of a wood planing machine according to the present invention.
Figure 6:
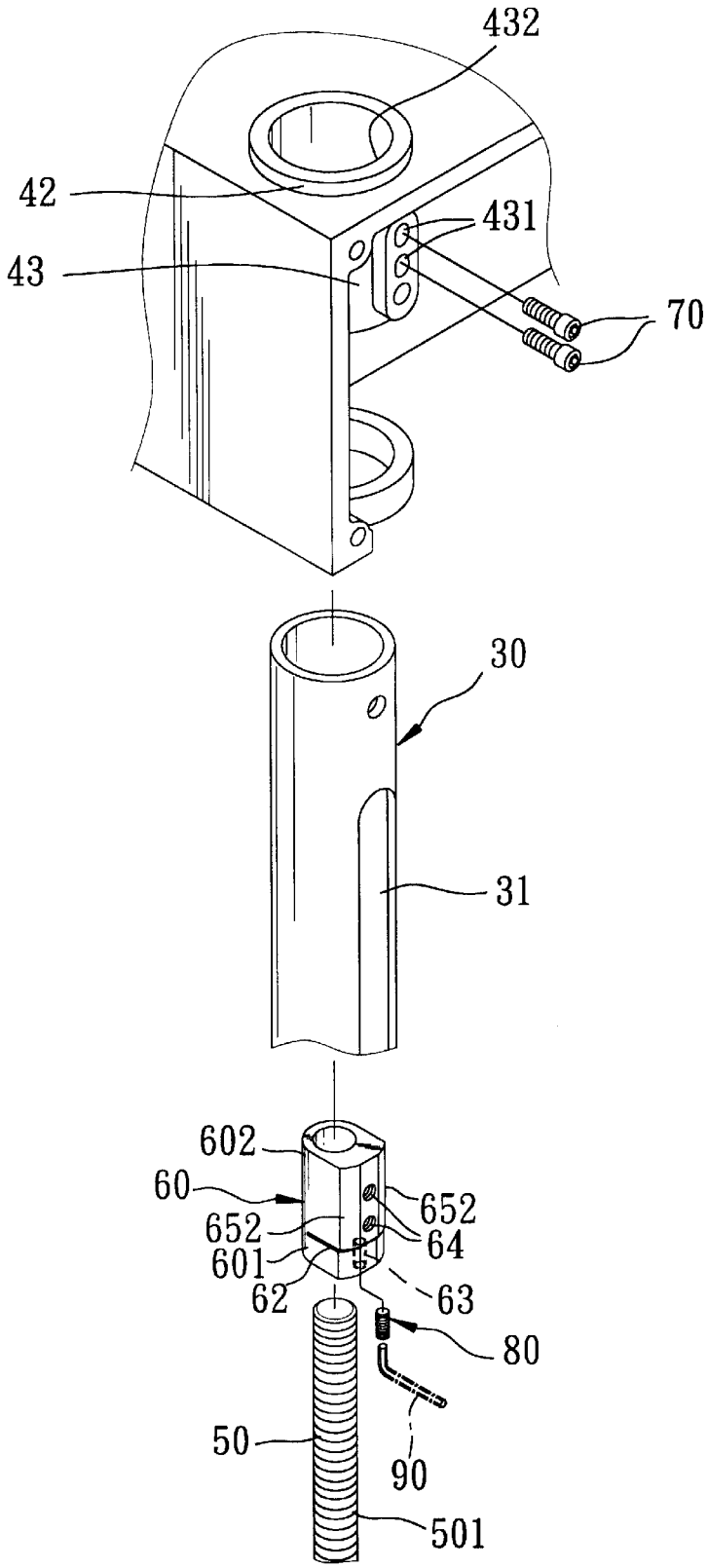
FIG. 6 is a fragmentary exploded view of the preferred embodiment, illustrating how a threaded member is mounted on a screw rod.
Figure 7:
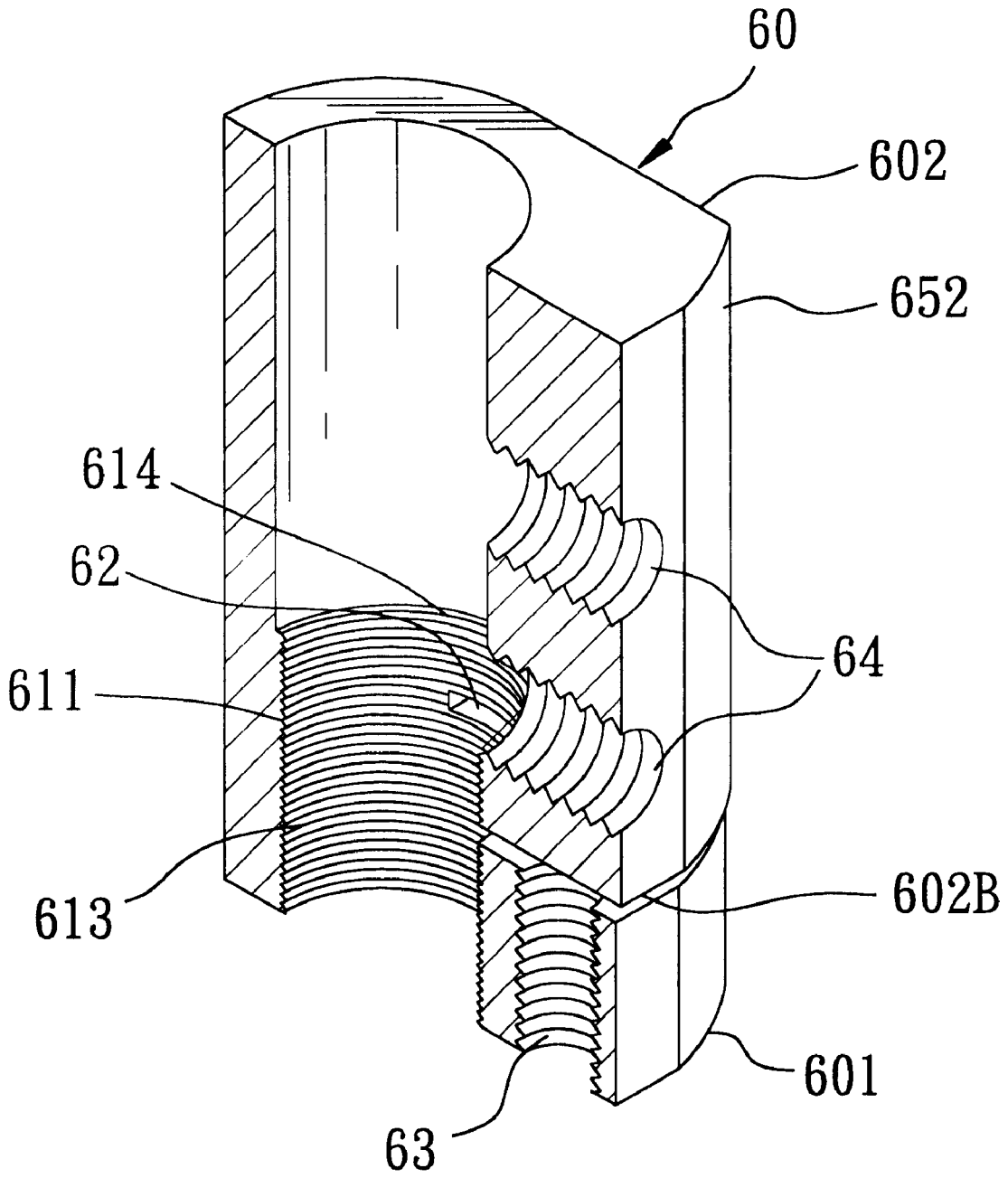
FIG. 7 is an enlarged, fragmentary, partly sectional perspective view of the threaded member shown in FIG. 6.

Referring to FIGS. 5 to 7, the preferred embodiment of a wood planing machine according to the present invention is shown to include a base 20, two pairs of hollow posts 30, two pairs of screw rods 50, 51, a transmission unit 130, a cutter carriage 40, and an error reducing unit.

As illustrated, the base 20 has four corners 201, 202.

The hollow posts 30 are mounted on the base 20 via four tubular seats 21, and extend uprightly and respectively from the corners 201, 202 of the base 20. Each of the posts 30 is formed with an axial slot 31 for access to an interior thereof.

The screw rods 50 are mounted on the corners 201, 202 of the base 20 via four bearings (not shown) in such a manner that the screw rods 50 extend rotatably and uprightly therefrom through the posts 30, respectively. Each of the screw rods 50 has an externally threaded portion 501 that is formed with an external thread.

The cutter carriage 40 has four corners 42 mounted respectively, vertically and slidably on the posts 30, and a horizontal bottom surface 41.

The transmission unit 130 interconnects the screw rods 50 in a conventional manner to permit synchronous rotation of the screw rods 50.

The error reducing unit includes four tubular threaded members 60 (only one is shown in FIGS. 6 and 7) that are secured respectively to the four corners 42 of the carriage 40, that are disposed respectively within the posts 30 in such a manner that the threaded members 60 are exposed from the axial slots 31 in the posts 30, and that define axially extending threaded bores 611 (see FIG. 7) respectively engaging the screw rods 50 such that rotation of the screw rods 50 results in vertical movement of the carriage 40 along the posts 30.

Each of the threaded members 60 has an internally threaded portion 613 that defines a respective one of the axially extending threaded bores 611 and that engages the externally threaded portion 501 of the respective one of the screw rods 50, and a circumferential slot 62 that is formed through a wall of the internally threaded portion 613 so as to divide the internally threaded portion 613 into an upper part 602 and a lower part 601. The upper part 602 is disposed above the circumferential slot 62, and has a bottom surface 602B that defines a top end of the circumferential slot 62. The lower part 601 is disposed below the circumferential slot 62, and is formed with a vertically extending threaded bore 63 therethrough. Each of the upper and lower parts 602, 601 is formed with an internal thread that engages the external thread of the respective one of the screw rods 50. The error reducing unit further includes four locking bolts 80 ( only one is shown in FIG. 6) that engage respectively the vertically extending threaded bores 63 in the threaded members 60, and that press against the bottom surfaces 602B of the upper parts 602 of the internally threaded portions 613 of the threaded members 60 such that the circumferential slots 62 are enlarged along a vertical direction, in which, the internal threads of the upper parts 602 of the threaded members 60 press upwardly against the external threads of the screw rods 50, and in which, the internal threads of the lower part 601 of the threaded members 60 press downwardly against the external threads of the screw rods 50 so as to lock the internally threaded portions 613 of the threaded members 60 on the externally threaded portions 501 of the screw rods 50, thereby arresting inclination of the bottom surface 41 of the carriage 40 when the wood planing machine is in use.

In this preferred embodiment, each of the corners 42 of the carriage 40 includes a fixed sleeve 43, which is disposed around a respective one of the threaded members 60 and which is formed with a vertical row of three bolt extension holes 431. The upper part 602 of each of the threaded members 60 is formed with two horizontal threaded holes 64. The wood planing machine of the present invention further includes four pairs of fastener bolts 70. Each pair of the fastener bolts 70 extend respectively through an adjacent pair of the bolt extension holes 431 in a respective one of the sleeves 43, and engage respectively the horizontal threaded holes 64 in the respective one of the threaded members 60, thereby securing the threaded members 60 to the carriage 40.

Figure 8:
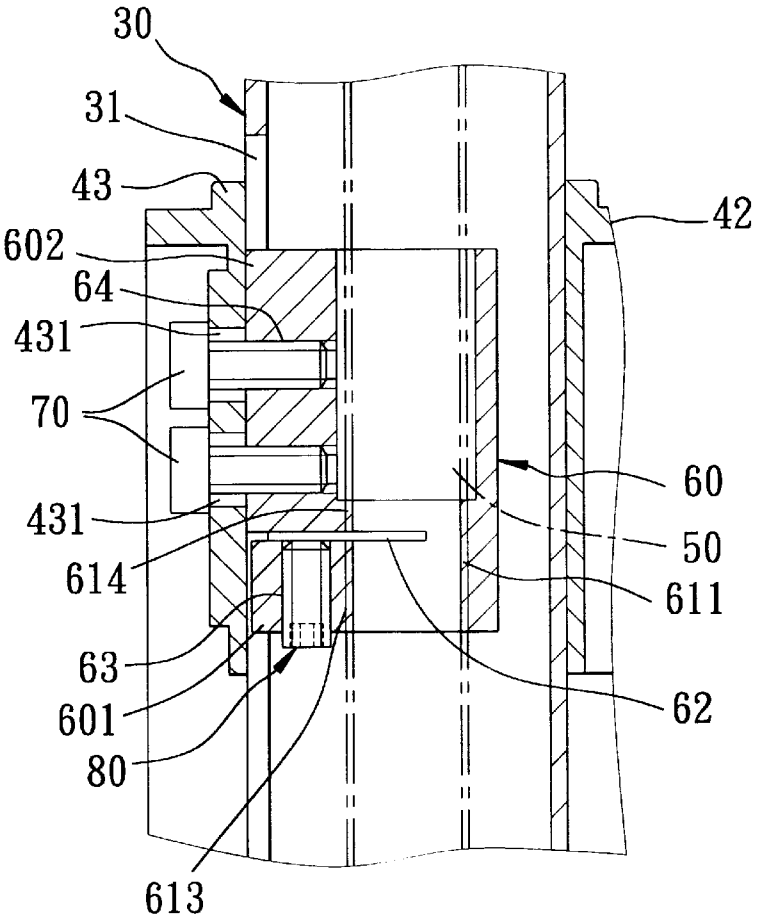
FIGS. 8 and 9 are fragmentary sectional views of the preferred embodiment prior to adjustment of the threaded member.
Figure 9:
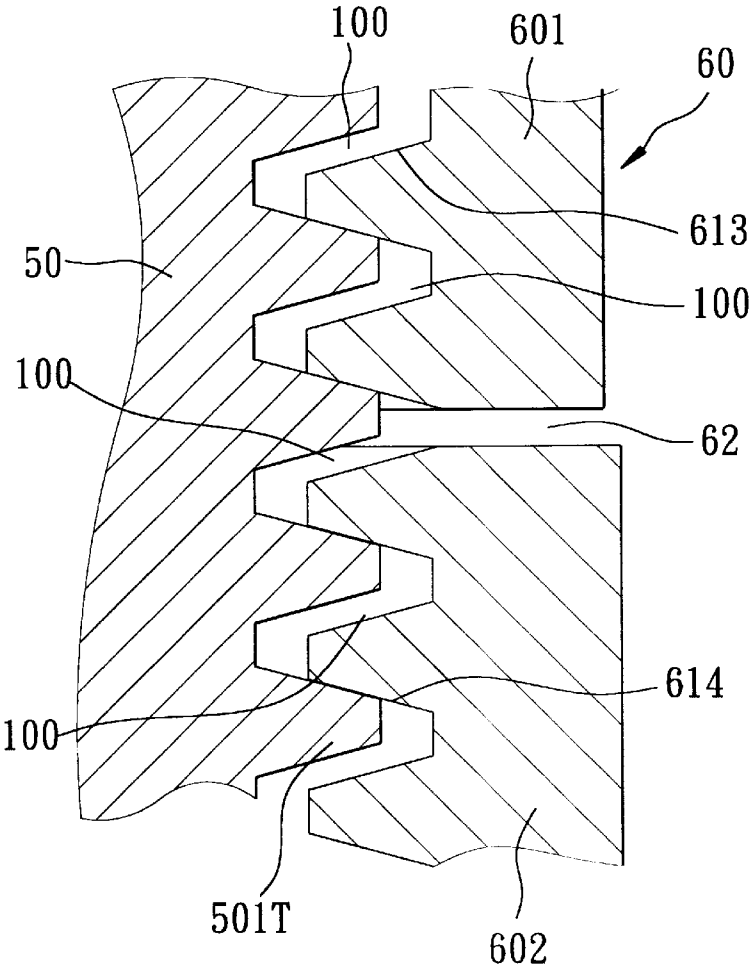

Referring to FIGS. 8 and 9, when the internally threaded portions 613 of the threaded members 60 engage the externally threaded portion 501 of the screw rods 50, the threads 614 of the threaded members 60 rest on the threads (501T) of the screw rods 50 due to the weight of the carriage 40. Thus, clearances 100 are thus formed between the thread (501T) of the screw rod 50 and the thread 614 of the threaded member 60.

Figure 10:
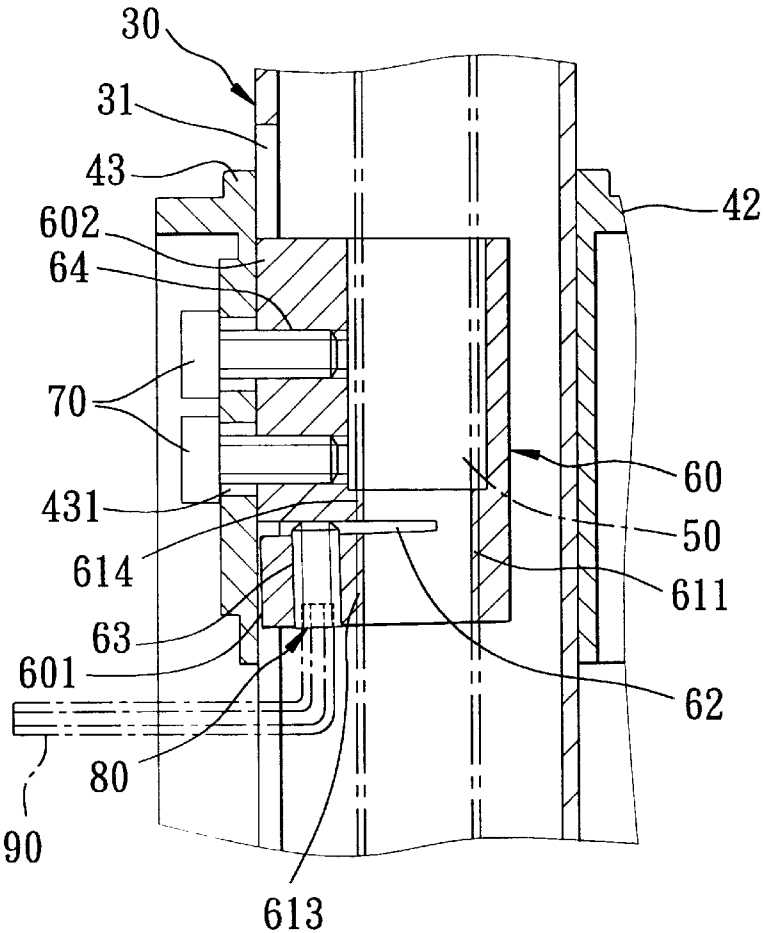
FIG. 10 is a fragmentary sectional view of the preferred embodiment, illustrating how the threaded member is adjusted by a tool in order to dispose a horizontal bottom surface of the cutter carriage at a horizontal position.
Figure 11:
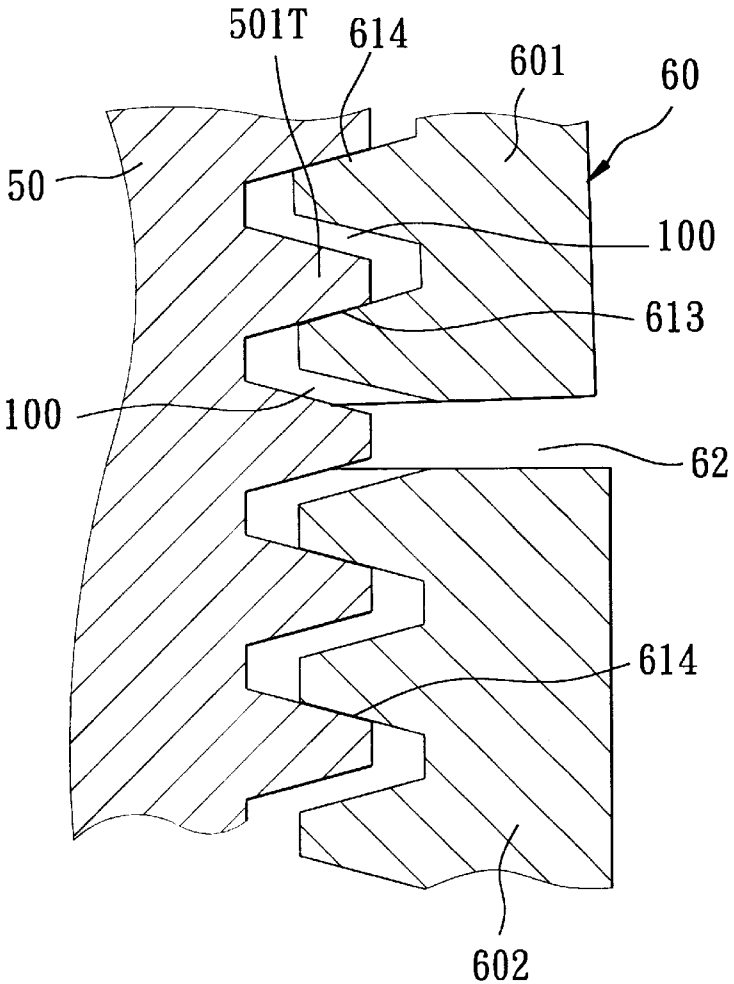
FIG. 11 illustrates a relationship between the threaded member and the screw rod of the preferred embodiment after adjustment of the threaded member.

Referring to FIGS. 10 and 11, when it is desired to prevent movement of the carriage 40 relative to the screw rods 50, the locking bolts 80 can be threaded into the threaded bores 63 in the threaded members 60 using an operating tool 90 so that the bolts 80 can press against the bottom surfaces 602B of the upper parts 602 of the internally threaded portions 613 of the threaded members 60. At this time, the circumferential slots 62 are enlarged along a vertical direction such that the internal threads 614 of the upper parts 602 of the threaded members 60 press upwardly against the external threads 501T of the external thread portion 501 of the screw rods 50, and that the internal threads 614 of-the lower parts 601 of the threaded members 60 press downwardly against the external threads (501T) of the externally threaded portions 501 of the screw rods 50, thereby locking the internally threaded portions 613 of the threaded members 60 on the externally threaded portions 501 of the screw rods 50 so as to arrest inclination of the bottom surface 41 of the carriage 40 when the wood planing machine is in use.

Figure 12:
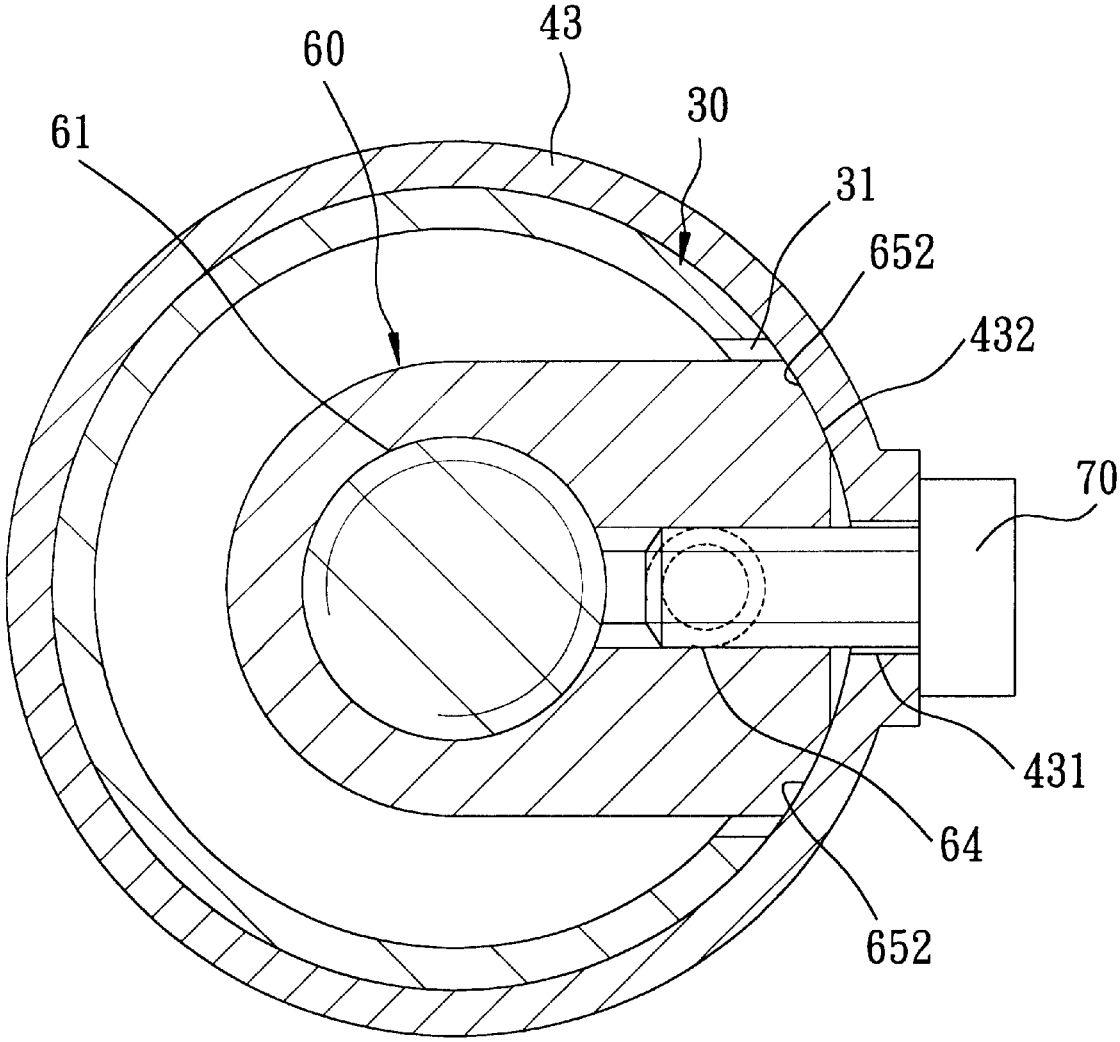
FIG. 12 is a cross-sectional view of the preferred embodiment, illustrating how the threaded member is secured to the cutter carriage.

Referring to FIG. 12, each of the threaded members 60 has two spaced-apart curved abutment portions 652 that extend through the axial slot 31 in the respective one of the posts 30 and that abut against an inner wall 432 of the respective one of the sleeves 43 when the fastener bolt 70 extends through the corresponding bolt extension hole 431 in the respective one of the sleeves 43 to engage the corresponding horizontal threaded hole 64 in the respective one of the threaded members 60.

With this invention thus explained, it is apparent that numerous modifications and variations can be made without departing from the scope and spirit of this invention. It is therefore intended that the invention be limited only as indicated in the appended claims.

I claim:

1. A wood planing machine comprising:

a base having four corners;

four hollow posts extending uprightly from said corners of said base, respectively, each of said posts being formed with an axial slot for access to an interior thereof;

four screw rods extending rotatably and uprightly from said corners of said base through said posts, respectively, each of said screw rods having an externally threaded portion that is formed with an external thread;

a cutter carriage having four corners mounted respectively , vertically and slidably on said posts, and a horizontal bottom surface;

a transmission unit connected to said screw rods to permit synchronous rotation of said screw rods; and an error reducing unit including four tubular threaded members that are secured respectively to said four corners of said carriage, that are disposed respectively within said posts in such a manner that said threaded members are exposed from said axial slots in said posts, and that define axially extending threaded bores respectively engaging said screw rods such that rotation of said screw rods results in movement of said carriage along said posts, each of said threaded members having an internally threaded portion defining a respective one of said axially extending threaded bores and engaging said externally threaded portion of the respective one of said screw rods, and a circumferential slot formed through a wall of said internally threaded portion so as to divide said internally threaded portion into an upper part and a lower part, said upper part being disposed above said circumferential slot and having a bottom surface that defines a top end of said circumferential slot, said lower part being disposed below said circumferential slot and being formed with a vertically extending threaded bore therethrough, each of said upper and lower parts being formed with an internal thread that engages said external thread of the respective one of said screw rods, said error reducing unit further including four locking bolts that engage respectively said vertically extending threaded bores in said threaded members and that press against said bottom surfaces of said upper parts of said internally threaded portions of said threaded members such that said internal threads of said upper parts of said threaded members press upwardly against said external threads of said screw rods and such that said internal threads of said lower parts of said threaded members press downwardly against said external threads of said screw rods so as to lock said internally threaded portions of said threaded members 60 on said externally threaded portions of said screw rods 50.

2. The wood planing machine as defined in claim 1, wherein each of said corners of said carriage includes a fixed sleeve, which is disposed around a respective one of said threaded members and which is formed with a row of bolt extension holes, each of said threaded members being formed with two horizontal threaded holes, said wood planing machine further including four pairs of fastener bolts, each pair of said fastener bolts extending respectively through an adjacent pair of said bolt extension holes in a respective one of said sleeves and engaging respectively said horizontal threaded holes in the respective one of said threaded members, thereby securing said threaded members 60 to said carriage 40.

3. The wood planing machine as defined in claim 2, wherein each of said sleeves has an inner wall, each of said threaded members having two spaced-apart abutment portions that extend through said axial slot in the respective one of said posts and that abut against said inner wall of the respective one of said sleeves.

* * * * *